US008441428B2

(12) United States Patent
Kim et al.

(10) Patent No.: US 8,441,428 B2
(45) Date of Patent: May 14, 2013

(54) POWER SUPPLY FOR LIQUID CRYSTAL DISPLAY

(75) Inventors: Jong Duck Kim, Gyunggi-do (KR); Ho Jae Lee, Gyunggi-do (KR)

(73) Assignee: Samsung Electro-Mechanics Co., Ltd. (KR)

( * ) Notice: Subject to any disclaimer, the term of this patent is extended or adjusted under 35 U.S.C. 154(b) by 521 days.

(21) Appl. No.: 12/640,288

(22) Filed: Dec. 17, 2009

(65) Prior Publication Data

US 2011/0043510 A1 Feb. 24, 2011

(30) Foreign Application Priority Data

Aug. 19, 2009 (KR) ..... 10-2009-0076875

(51) Int. Cl.
*G09G 5/00* (2006.01)

(52) U.S. Cl.
USPC ..... 345/102; 345/30

(58) Field of Classification Search ..... None
See application file for complete search history.

(56) References Cited

U.S. PATENT DOCUMENTS

| | | | | |
|---|---|---|---|---|
| 6,888,529 | B2 * | 5/2005 | Bruning et al. | 345/102 |
| 2008/0002102 | A1 * | 1/2008 | Lee | 349/68 |
| 2009/0261755 | A1 * | 10/2009 | Choi et al. | 315/297 |

FOREIGN PATENT DOCUMENTS

| | | | |
|---|---|---|---|
| KR | 1020060055658 | | 5/2006 |
| KR | 1020060094767 | | 8/2006 |
| KR | 1020070015857 | A | 2/2007 |
| KR | 1020080001049 | A | 1/2008 |
| KR | 1020100072801 | A | 7/2010 |

OTHER PUBLICATIONS

Korean Office Action for Application No. 10-2009-0076875, issued Jan. 19, 2011.

* cited by examiner

*Primary Examiner* — Van Chow
(74) *Attorney, Agent, or Firm* — Lowe Hauptman Ham & Berner, LLP

(57) ABSTRACT

The invention relates to a power supply for a liquid crystal display using a light emitting diode for a backlight unit, and more particularly, to a power supply combining a DC power supply outside the liquid crystal display with a driving power supply inside the liquid crystal display into a single power supply. The power supply for a liquid crystal display according to an aspect of the invention may include: a power conversion section converting commercial AC power into at least one operating power having a predetermined voltage level through a switching operation; a backlight driving section switching the operating power from the power conversion section into backlight driving power; and a power switching control section controlling the switching operation of the power conversion section on the basis of a first feedback signal having a voltage level of the operating power from the power conversion section and a second feedback signal having a voltage level of the backlight driving power from the backlight driving section, wherein the power conversion section, the backlight driving section and the power switching control section are mounted on a single printed circuit board.

16 Claims, 2 Drawing Sheets

POWER SUPPLY FOR LIQUID CRYSTAL DISPLAY

CROSS-REFERENCE TO RELATED APPLICATIONS

This application claims the priority of Korean Patent Application No. 10-2009-0076875 filed on Aug. 19, 2009, in the Korean Intellectual Property Office, the disclosure of which is incorporated herein by reference.

BACKGROUND OF THE INVENTION

1. Field of the Invention

The present invention relates to a power supply for a liquid crystal display, and more particularly, to a power supply for a liquid crystal display using a light emitting diode for a backlight unit, the power supply integrating a DC power supply outside the liquid crystal display and a driving power supply inside the liquid crystal display to a single power supply.

2. Description of the Related Art

Among display devices, liquid crystal displays (LCDs) have recently been used for various kinds of products, such as desktop computers, laptop computers and AV equipment due to the fact that they have desirable features, such as small size, light weight and low power consumption.

These liquid crystal displays employ backlight units which emit the light necessary for pixels.

A backlight unit includes a plurality of bar lamps, a power circuit supplying power to the plurality of bar lamps and driving power to another circuit, and a controller receiving the driving power to control the levels of lamp luminance.

As for the above-described lamps, cold cathode fluorescent lamps (CCFLs) are generally used. However, in consideration of process rates, power consumption and life spans, backlight units using light emitting diodes (LEDs) as light sources have appeared.

However, a backlight unit having these light emitting diodes operates with a separate power supply by additionally using an external DC power supply, such as an adapter. The use of the external DC power supply may cause costs incurred for the provision of a power cable, a case and a printed circuit board (PCB) forming an adapter, reduce the mobility of liquid crystal displays and harm the appearance of liquid crystal displays.

SUMMARY OF THE INVENTION

An aspect of the present invention provides a power supply for a liquid crystal display that integrates a DC power supply outside a liquid crystal display and a driving power supply outside the liquid crystal display into a single power supply.

According to an aspect of the present invention, there is provided a power supply for a liquid crystal display, including: a power conversion section converting commercial AC power into at least one operating power having a predetermined voltage level through a switching operation; a backlight driving section switching the operating power from the power conversion section into backlight driving power; and a power switching control section controlling the switching operation of the power conversion section on the basis of a first feedback signal having a voltage level of the operating power from the power conversion section and a second feedback signal having a voltage level of the backlight driving power from the backlight driving section, wherein the power conversion section, the backlight driving section and the power switching control section are mounted on a single printed circuit board.

The power conversion section may include: a rectifier rectifying and smoothing commercial AC power; a switching unit switching the power rectified and the smoothed by the rectifier; and a transformation unit transforming a voltage level of the power switched by the switching unit to supply the operating power.

The transformation unit may include: a primary winding receiving the power switched by the switching unit; a first secondary winding forming a predetermined first turns ratio relative to the primary winding to output first operating power; and a second secondary winding forming a predetermined second turns ratio relative to the primary winding to output second operating power.

The backlight driving section may include: a switching unit switching the first operating power on and off; and a current control unit including a plurality of transistors operating upon receiving the power switched by the switching unit to supply the backlight driving power to individual light emitting diodes of a light emitting diode backlight, the plurality of transistors controlling currents of the backlight driving power being supplied.

The power supply may further include a switching control unit controlling a switching operation of the switching unit on the basis of a dimming control signal and a voltage level of the backlight driving power transmitted from each of the plurality of transistors, the voltage level thereof being feed back.

The power supply may further include an image control section supplying the dimming control signal to the switching control unit according to an image signal from the outside.

The power supply may further include a constant voltage section maintaining a voltage level of the second operating power at a predetermined voltage level to supply the second operating power having the voltage level to the image control section.

The power switching control section may include: a shunt regulator having a reference receiving a voltage level difference between the first feedback signal and the second feedback signal, an anode connected to a ground, and a cathode receiving driving power having a predetermined voltage; a photocoupler causing a current flowing through the shunt regulator to be feed back; and a switching controller controlling a switching operation of the switching unit according to a feedback signal from the photocoupler.

At least one of the switching control section, the image control section and the constant voltage section may be mounted on the single printed circuit board.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
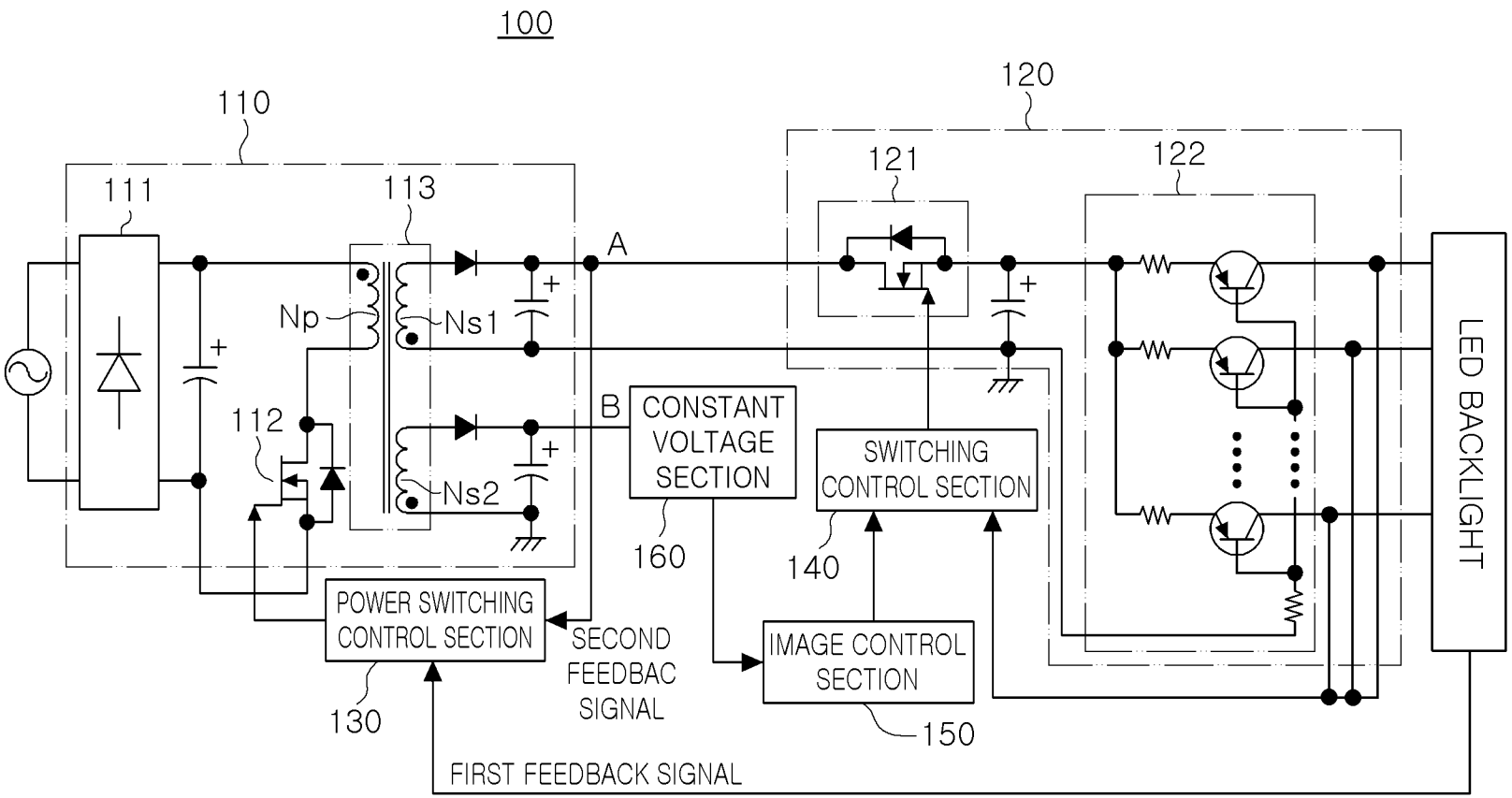
FIG. 1 is a schematic view illustrating the configuration of a power supply according to an exemplary embodiment of the present invention.

FIG. 1 is a schematic view illustrating the configuration of a power supply according to an exemplary embodiment of the invention.

Referring to FIG. 1, a power supply 100 according to this embodiment may include a power conversion section 110, a backlight driving section 120 and a power switching control section 130. The power supply 100 may further include a switching control section 140, an image control section 150 and a constant voltage section 160.

The power conversion section 110 may include a rectification unit 111, a switching unit 112 and a transformation unit 113.

The rectification unit 111 may receive commercial AC power to rectify and smooth the received commercial AC power.

The switching unit 112 may switch the power, rectified and smoothed by the rectification unit 111, according to a control signal.

The transformation unit 113 may include a primary winding Np and first and second secondary windings Ns1 and Ns2. The primary winding Np may receive the power switched by the switching unit 112 and have a predetermined turns ratio relative to the first and second secondary windings Ns1 and Ns2. The first and second secondary windings Ns1 and Ns2 convert a voltage level of the switched power according to the turns ratio relative to the primary winding Np to thereby output first and second operating powers A and B. The first operating power A may be transmitted to the backlight driving section 120, while the second operating power B may be transmitted to the constant voltage section 160.

The backlight driving section 120 may include a switching unit 121 and a current control unit 122.

The switching unit 121 may include a power output terminal of the power conversion section 110 and a switch connected in series with the current control unit 122 and perform on/off switching according to a control signal to thereby control an on/off duty cycle of the first operating power transmitted to the current control unit 122 from the power conversion section 110. Therefore, the switching unit 121 may control the luminance levels of a light emitting diode backlight having a plurality of light emitting diode arrays.

The current control unit 122 may include a plurality of transistors connected in parallel with each other between the switching unit 121 and the light emitting diode backlight. Though not shown in the drawings, the respective plurality of transistors may be electrically connected to the respective plurality of light emitting diode arrays. The plurality of transistors transmit backlight driving power from the switching unit 121 to the light emitting diode backlight. The currents of the backlight driving power being transmitted to the light emitting diode backlight may be controlled by turning the transistors on and off.

The power switching control section 130 may control the switching operation of the switching unit 112 on the basis of a first feedback signal obtained by detecting a current level of the backlight driving power via a voltage level, and a second feedback signal having a voltage level of the first operating power being feed back.

Figure 2:
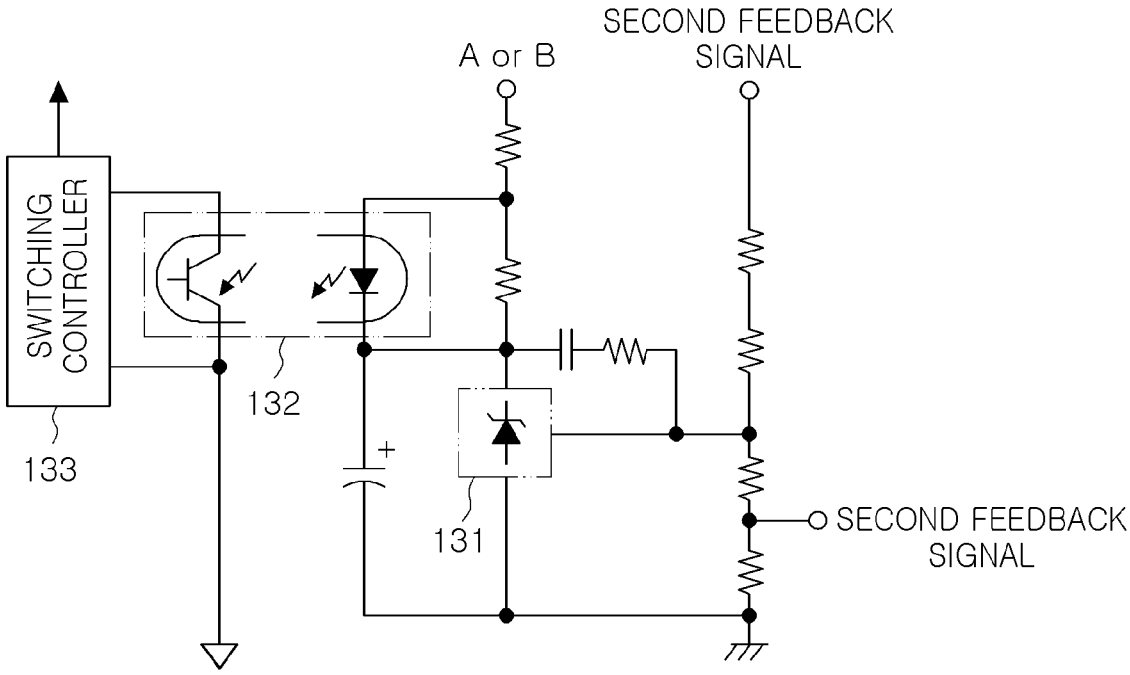
FIG. 2 is a schematic view illustrating the configuration of a power switching control section that is employed in a power supply according to an exemplary embodiment of the present invention.

FIG. 2 is a schematic view illustrating the configuration of a power switching control unit that is used in a power supply according to an exemplary embodiment of the invention.

Referring to FIG. 2, the power switching control section 130 may include a shunt regulator 131, a photocoupler 132 and a switching controller 133.

The shunt regulator 131 has a reference receiving a voltage level difference between the first and second feedback signals, an anode connected to a ground, and a cathode receiving power having a predetermined voltage level. When the power having a predetermined voltage level is supplied to the reference, the anode and the cathode come into electrical communication with each other. Here, the power being supplied to the cathode may be the first operating power A or the second operating power B.

The primary and secondary sides of the photocoupler 132 are electrically isolated from each other, so that currents, flowing when the shunt regulator 131 is turned on, are transmitted to the switching controller 133.

The switching controller 133 may control the switching on and off of the switching unit 112 on the basis of a feedback signal from the photocoupler 132.

The above-described components of the power supply 100, including the power conversion section 110, the backlight driving section 120 and the power switching control section 130 may be mounted on a single printed circuit board.

Referring to FIG. 1, the switching control section 140 may control the switching on and off of the switching unit 121. That is, a voltage level of the backlight driving power from each of the transistors of the current controller 122 is feed back to the switching control section 140 from the switching unit 121, and the switching control section 140 controls the on and off duty cycle of the switching unit 121 according to the transmitted feedback signal and a dimming signal being supplied, thereby performing dimming control to adjust the luminance levels of the LED backlight. Furthermore, it is possible to detect an open light emitting diode on the basis of the voltage level of the backlight driving power from each transistor of the current controller 122.

The image control unit 150 may process various kinds of image signals and supply the dimming signal to the switching control section 140 according to an image signal from the outside for an image being displayed on a screen.

The image control unit 150 may be supplied with power necessary for the operation, and the second operating power B from the second secondary winding Ns2 of the transformation unit 113 of the power conversion section 110 may be supplied to the image control unit 150. In order to maintain a voltage level of the second operating power B, the constant voltage section 160 may be used.

At least one of the above-described switching control section 140, the image control unit 150 and the constant voltage section 160 may be mounted on a single printed circuit board together with the power conversion section 110, the backlight driving section 120 and the power switching control section 130. Alternatively, the power conversion section 110, the backlight driving section 120, the power switching control section 130, the switching control section 140, the image control unit 150 and the constant voltage section 160 may all be mounted on a single printed circuit board.

As described above, according to an exemplary embodiment of the invention, as a power supply circuit and a backlight driving circuit at least are mounted on a single printed circuit board, manufacturing costs can be reduced, and a configuration of a dimming control signal of the backlight driving circuit can be simplified to further reduce manufacturing costs.

As set forth above, according to exemplary embodiments of the invention, as a DC power supply outside a liquid crystal display and an operating power supply inside the liquid crystal display are integrated into a single power supply, costs incurred for the provision of power cables, cases and printed circuit boards (PCBs) that form DC power supplies according to the related art, can be reduced, and the dimming control of an LED backlight is simply performed by controlling an on/off duty cycle of operating power, being supplied, on the basis of a dimming signal, thereby reducing manufacturing costs, increasing the mobility of liquid crystal displays and enhancing the appearance of liquid crystal displays.

While the present invention has been shown and described in connection with the exemplary embodiments, it will be apparent to those skilled in the art that modifications and variations can be made without departing from the spirit and scope of the invention as defined by the appended claims.

What is claimed is:

1. A power supply for a liquid crystal display, comprising:

a power conversion section converting commercial AC power into at least one operating power having a predetermined voltage level through a switching operation;

a backlight driving section switching the operating power from the power conversion section into backlight driving power; and a power switching control section controlling the switching operation of the power conversion section on the basis of a first feedback signal having a voltage level of the operating power from the power conversion section and a second feedback signal having a voltage level of the backlight driving power from the backlight driving section, wherein the power conversion section, the backlight driving section and the power switching control section are mounted on a single printed circuit board;

wherein the power conversion section comprises:

a rectifier rectifying and smoothing the commercial AC power;

a switching unit switching the power rectified and smoothed by the rectifier; and a transformation unit transforming a voltage level of the power switched by the switching unit to supply the operating power; and wherein the transformation unit comprises:

a primary winding receiving the power switched by the switching unit;

a first secondary winding forming a predetermined first turns ratio relative to the primary winding to output first operating power; and a second secondary winding forming a predetermined second turns ratio relative to the primary winding to output second operating power.

2. The power supply of claim 1, wherein the backlight driving section comprises:

a switching unit switching the first operating power on and off; and a current control unit including a plurality of transistors operating upon receiving the power switched by the switching unit to supply the backlight driving power to individual light emitting diodes of a light emitting diode backlight, the plurality of transistors controlling currents of the backlight driving power being supplied.

3. The power supply of claim 2, further comprising a switching control section controlling a switching operation of the switching unit on the basis of a dimming control signal and a voltage level of the backlight driving power transmitted from each of the plurality of transistors, the voltage level thereof being feed back.

4. The power supply of claim 3, further comprising an image control section supplying the dimming control signal to the switching control section according to an image signal from the outside.

5. The power supply of claim 4, further comprising a constant voltage section maintaining a voltage level of the second operating power at a predetermined voltage level to supply the second operating power having the voltage level to the image control section.

6. The power supply of claim 5, wherein at least one of the switching control section, the image control section and the constant voltage section is mounted on the single printed circuit board.

7. The power supply of claim 1, wherein the power switching control section comprises:

a shunt regulator having a reference receiving a voltage level difference between the first feedback signal and the second feedback signal, an anode connected to a ground, and a cathode receiving driving power having a predetermined voltage;

a photocoupler causing a current flowing through the shunt regulator to be feed back; and a switching controller controlling a switching operation of the switching unit according to a feedback signal from the photocoupler.

8. A device, comprising:

a liquid crystal display (LCD) comprising the power supply of claim 1.

9. A device, comprising:

a desktop computer assembly comprising the power supply of claim 1.

10. A device, comprising:

a desktop computer assembly including a liquid crystal display (LCD) comprising the power supply of claim 1.

11. A device, comprising:

a laptop computer assembly comprising the power supply of claim 1.

12. A device, comprising:

a laptop computer assembly including a liquid crystal display (LCD) comprising the power supply of claim 1.

13. A method, comprising:

manufacturing a power supply for a liquid crystal display having the following components:

a power conversion section converting commercial AC power into at least one operating power having a predetermined voltage level through a switching operation;

a backlight driving section switching the operating power from the power conversion section into backlight driving power; and a power switching control section controlling the switching operation of the power conversion section on the basis of a first feedback signal having a voltage level of the operating power from the power conversion section and a second feedback signal having a voltage level of the backlight driving power from the backlight driving section, wherein the power conversion section, the backlight driving section and the power switching control section are mounted on a single printed circuit board;

wherein the power conversion section comprises:

a rectifier rectifying and smoothing the commercial AC power;

a switching unit switching the power rectified and smoothed by the rectifier; and a transformation unit transforming a voltage level of the power switched by the switching unit to supply the operating power; and wherein the transformation unit comprises:

a primary winding receiving the power switched by the switching unit;

a first secondary winding forming a predetermined first turns ratio relative to the primary winding to output first operating power; and a second secondary winding forming a predetermined second turns ratio relative to the primary winding to output second operating power.

14. A method, comprising:

manufacturing a liquid crystal display, wherein the action of manufacturing the liquid crystal display includes executing the method of claim 13.

15. A method, comprising:

manufacturing a desktop computer assembly, wherein the action of manufacturing the desktop computer assembly includes executing the method of claim 13.

16. A method, comprising:

manufacturing a laptop computer assembly, wherein the action of manufacturing the laptop computer assembly includes executing the method of claim 13.

* * * * *